United States Patent [19]

Sugiura

[11] 4,253,798

[45] Mar. 3, 1981

[54] CENTRIFUGAL PUMP

[76] Inventor: Eiichi Sugiura, 149, Matsumotocho, Hekinan-shi, Aichi-ken, Japan

[21] Appl. No.: 931,918

[22] Filed: Aug. 8, 1978

[51] Int. Cl.[3] ..... F04D 29/22

[52] U.S. Cl. ..... 415/213 R; 416/186 R

[58] Field of Search ..... 415/213 R; 416/184, 416/185, 186

[56] References Cited

U.S. PATENT DOCUMENTS

| | | | |
|---|---|---|---|
| 1,406,297 | 2/1922 | Stewart | 415/130 |
| 2,165,808 | 7/1939 | Murphy | 415/213 R X |
| 2,767,906 | 10/1956 | Doyle | 416/186 |
| 3,647,314 | 3/1972 | Laessig | 415/213 R X |
| 3,816,020 | 6/1974 | Ogles | 415/213 R X |

FOREIGN PATENT DOCUMENTS

| | | | |
|---|---|---|---|
| 568031 | 12/1958 | Canada | 415/213 R |
| 644854 | 7/1962 | Canada | 415/213 R |
| 376834 | 7/1932 | United Kingdom | 416/186 |

*Primary Examiner*—Leonard E. Smith

*Attorney, Agent, or Firm*—Robert E. Burns; Emmanuel J. Lobato; Bruce L. Adams

[57] ABSTRACT

A centrifugal pump includes an impeller and a volute casing. The impeller comprises a main disc and a plurality of vanes which project axially from at least one side of the disc. A fluid passage is formed between each pair of adjacent vanes. The passage has a constant depth and a gradually decreasing width from an inlet to an outlet thereof. Each fluid passage assures a flow of the fluid along the front surface of the associated vane and prevents the occurrence of a vortical flow therein. The volute casing has an inner surface which is substantially U-shaped in section and effectively converts the kinetic energy imparted to the fluid by the impeller into hydraulic pressures.

7 Claims, 9 Drawing Figures

CENTRIFUGAL PUMP

FIELD OF THE INVENTION

The invention relates to a centrifugal pump, and more particularly, to an improved impeller of a centrifugal pump which prevents a vortical fluid flow from occurring in passages defined between vanes.

DESCRIPTION OF THE PRIOR ART

In the art of centrifugal pumps, an impeller of the form well known for many years is still in use today. The impeller has a plurality of vanes which define fluid passages therebetween. The fluid passages have a width which rapidly increases from the inlet to the outlet. It is known that such an impeller suffers from a significant loss of head as a result of vortical flow occurring in the passages. Nevertheless the traditional form of impeller has been relied upon in practical use.

A theoretical analysis of the action of an impeller assumes an "ideal impeller" which has an infinite number of vanes having an infinitesimal thickness, with the fluid flowing along the curved surface of the vanes without experiencing any frictional loss. Referring to FIG. 1, the ideal impeller is partly illustrated, with fluid flowing into an inlet with an angle $\alpha_1$ and a velocity $c_1$. Assuming a peripheral speed $u_1$ of the impeller at this point, the fluid has a relative velocity of $w_1$ with respect to the vanes. The inlet angle $\beta_1$ of the vane is chosen to be aligned with the direction of the relative velocity $w_1$. After flowing along the curved surface of the vane, the fluid exits the vane outlet with a relative velocity $w_2$. If the peripheral speed of the impeller is $u_2$ at the outlet, the fluid which departs from the impeller will have an absolute velocity $c_2$, a resultant of $w_2$ and $u_2$, the direction of which is represented by an angle $\alpha_2$. It is presumed that particles of the fluid located on the same curved surface of the vane move in the same direction and with the same velocity. Since the fluid flows along the curved vane surface and simultaneously rotates together with the impeller, the acutal path of movement of the fluid will be represented by a curve $B_1B_2'$ starting from the entrance point $B_1$, and exiting at the point $B_2'$ at the angle $\alpha_2$.

An increase in the pressure head $h_2-h_1$ between the outlet and the inlet of the ideal impeller will be given as follows:

$$h_2 - h_1 = \frac{u_2^2 - u_1^2}{2g} - \frac{w_2^2 - w_1^2}{2g} \quad (1)$$

where g represents the gravitational acceleration. An increase in the velocity head is given by $$(c_2^2-c_1^2)/2g \quad (2)$$

The vane imparts a head to the fluid which is the difference between the total head at the outlet and the total head at the inlet. Thus, the theoretical head $H_{th}\infty$ will be $$H_{th}\infty = \frac{u_2^2 - u_1^2}{2g} + \frac{c_2^2 - c_1^2}{2g} - \frac{w_2^2 - w_1^2}{2g} \quad (3)$$

FIG. 2 shows the velocity diagrams at the inlet and the outlet. It will be seen from these diagrams that $$w_2^2=c_2^2+u_2^2-2c_2u_2\cos\alpha_2$$

$$w_1^2=c_1^2+u_1^2-2c_1u_1\cos\alpha_1$$

Substitution of these expressions into the equation (3) yields:

$$H_{th}\infty=(u_2c_2\cos\alpha_2-u_1c_1\cos\alpha_1)/g \quad (4)$$

If $\alpha_1=90°$, $\cos\alpha_1=0$, and hence $$H_{th}\infty=(u_2c_2\cos\alpha_2)/g=(u_2c_{2u})/g \quad (5)$$

The theoretical head of an actual impeller is substantially reduced from the value given by the equation (5) since it has only several vanes and since in most impellers of the prior art type as illustrated in FIG. 3, adjacent vanes define a passage therebetween which is broad enough to permit a free flow, causing a complicate flow situation. The head of an actual pump can be represented as follows:

$$H=(\phi u_2c_2\cos\alpha_2)/g \quad (6)$$

where $\phi$ represents a coefficient having a magnitude which depends on the configuration and the number of vanes and the specific speed of the impeller and which usually ranges from 0.5 to 0.8.

In known impeller constructions, the broad passages formed between adjacent vanes fail to provide a fluid flow along the curved vane surface, resulting in non-uniform velocity and pressure distribution along the curved surface. Because the velocity and pressure are higher at the front surface than at the rear surface of the vane, the pressure and speed differentials across the vanes cause a kind of complicate vortical flow. This will be considered in more detail with reference to FIG. 3. A conventional centrifugal pump includes an impeller 10 having a plurality of vanes 11 of substantially uniform thickness. Each vane 11 is disposed on a side of a main disc 12 having a boss 13 which is firmly mounted on a drive shaft 14. As is well known, the impeller 10 is received in a body 17 having a volute casing 16 which defines a spiral space 15 around the impeller. Fluid is admitted axially around the boss 13 as the impeller 10 rotates, and is delivered to the spiral space 15 through passages 18 defined between adjacent vanes 11. The fluid obtains kinetic energy during its passage through the passages 18, and the kinetic energy is converted into hydraulic pressures in the spiral space 15. As mentioned, in the conventional pump, the passages 18 of the impeller 10 has an inlet 19 which is restricted and an outlet 20 which has an increased opening size, giving rise to a vortical flow within the passages 18, such flow being illustratively shown by arrows c.

Such vortical flow has influences upon the actual velocity diagrams as indicated by broken lines in FIG. 1. Specifically, while the velocity diagram of the ideal impeller at the outlet is represented by $A_2B_2D_2$, the actual impeller will have a velocity diagram $A_2'B_2D_2$, involving a flow slip caused by vortical flow $\overline{A_2A_2'}$. Similar slip also occurs at the inlet, but can be neglected because of the reduced magnitude. Taking into consideration the entire flow slip at the outlet, the theoretical head of the actual impeller is given by the following expression:

$$H_{th} = \frac{u_2 c_2' \cos\alpha_2'}{g} = \frac{u_2(c_2 \cos\alpha_2 - k_2 u_2)}{g} \quad (7)$$

where $k_2u_2$ represents the flow slip at the outlet, and $k_2$ a coefficient.

As discussed above, it is found that the principal loss of head of conventional impellers is caused by a flow slip which occurs as a result of a kind of vortical flow which exists within the passages between adjacent vanes. In order to prevent vortical flows from occurring in the passages formed between adjacent vanes and to assure a uniform flow of fluid along the curved surface of the vanes as it is assumed in the ideal impeller, the inventor has proposed a uniform width and depth of passages in Japanese laid-open patent application No. 49-114,101, which was laid open on Oct. 31, 1974. The width of the passage as termed herein refers to the spacing between the front surface of a vane and the rear surface of an adjacent vane while the depth of the passage refers to the axial dimension of a vane. The proposed arrangement suffered from the disadvantages, however, that the constant cross-sectional area of the passage over the entire length thereof cannot accommodate a flow of fluid having a velocity which increases from the inlet toward the outlet.

An improvement impeller has been subsequently proposed in Japanese Utility Model application No. 50-26,323, which was filed on Feb. 10, 1975 and in which the width of the passage remains constant while the depth decreases gradually from the inlet toward the outlet. The improved impeller exhibited an excellent efficiency and an actual head which is significantly higher than that of the conventional design, but still cannot be fully satisfactory.

SUMMARY OF THE INVENTION

It is an object of the invention to provide a centrifugal pump which has a low loss and produces an increased head.

It is a specific object of the invention to provide an impeller for a centrifugal pump which is substantially free from a vortical flow in its passages defined between adjacent vanes, allowing fluid flow along the curved surface of the vanes.

In accordance with the invention, there is provided a centrifugal pump comprising a drive shaft, an impeller firmly mounted on the drive shaft, and a body including an inlet path communicating with the impeller and also including a volute casing which defines a spiral space around the impeller, the impeller including a main disc having a boss which is fitted over the shaft and a plurality of vanes which are disposed at an equal spacing from each other and axially project from at least one side of the disc, each vane having a front and a rear surface, part of the rear surface being opposite to and spaced from the boss in surrounding relationship therewith, a fluid passage being formed between the front surface of each vane and the remainder of the rear surface of its adjacent vane and extending from a region around the boss to the outer periphery of the disc, each vane having a constant axial thickness, the major part of the front surface of a vane and the rear surface of an adjacent vane which form together a passage therebetween being segments of circles struck from different points on the disc and of different radii so that the passage formed therebetween have a constant depth and a width which gradually decreases from said region toward the outer periphery of the disc.

In the centrifugal pump of the invention, the fluid passages formed between adjacent vanes have a cross-sectional area which gradually decreases from the inlet toward the outlet. Since the depth of the passage remains constant, the fluid flows along the front surface of the associated vane, whereby the centrifugal force of the vane imparts kinetic energy to the fluid. The occurrence of a vortical flow, cavity or air bubbles within the fluid passage is substantially eliminated inasmuch as the fluid flows while filling the passage defined by arcuate surfaces having different radii of curvature. As a consequence, the loss of head in the impeller which is caused by vortical flow is almost eliminated, providing a pump with an increased head. Fluid containing a significant amount of air or of a relatively high temperature can be pumped without causing a cavitation.

In a preferred embodiment of the invention, the volute casing which defines the spiral space around the impeller has an inner surface which is U-shaped in longitudinal section. Admittedly, the theoretical design of a volute casing has been very difficult, which prevented the functional analysis of the volute casing. This is why conventional centrifugal pumps traditionally employ a volute casing which defines a spiral space which is circular in longitudinal section. Such a volute casing has been advantageous in providing a commutation of a fluid flow, as it exits the vane outlets, which assumes a complicate flow pattern as a result of the presence of vortical flows. However, the complicate flow pattern within the casing causes a non-uniform velocity profile, resulting in an increased fluid resistance. By contrast, the substantial absence of vortical flow in the fluid as it leaves the vane outlets removes the necessity of a commutation which is provided by the volute casing, the principal objective of which is then to achieve a high efficiency in converting the kinetic energy of the fluid into pressures. It is found that the volute casing defining a spiral space which is U-shaped in longitudinal section achieves a high conversion efficiency.

DESCRIPTION OF PREFERRED EMBODIMENT

Figure 1:
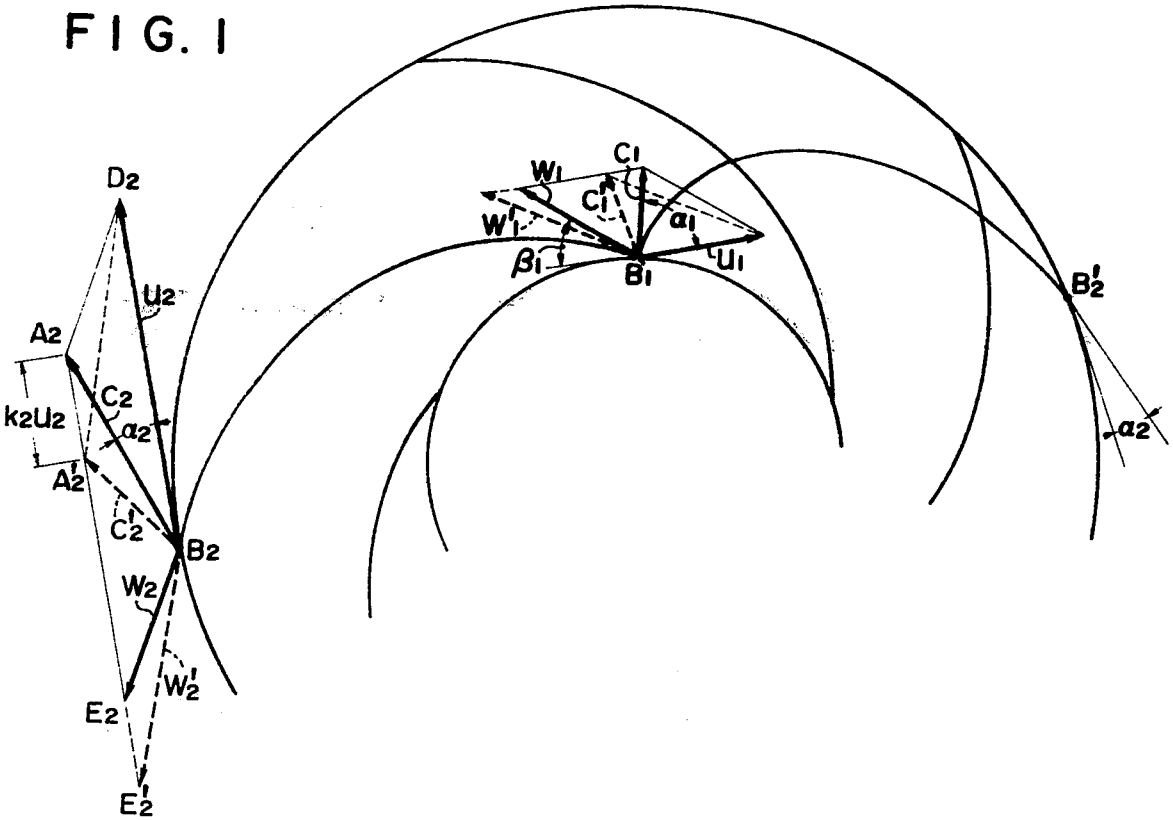
FIG. 1 is a velocity diagram of a centrifugal pump.
Figure 2:
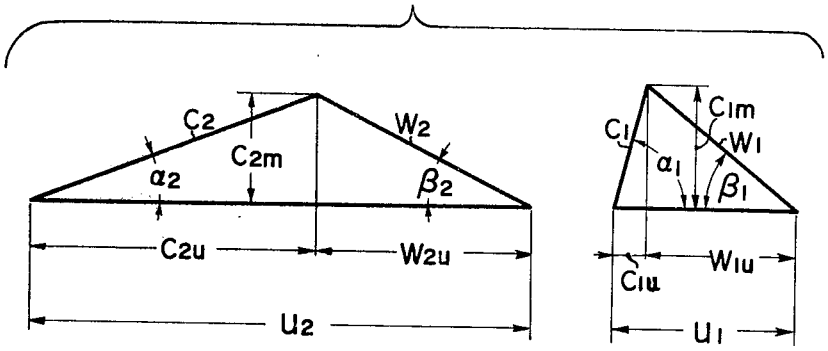
FIG. 2 shows the velocity triangles.

Referring to FIGS. 4 to 7 inclusively, there is shown a centrifugal pump constructed according to one embodiment of the invention. The pump includes an impeller 30 comprising a main disc 31 having an annular boss 32, and a plurality of vanes 33 which axially project from the opposite sides of the disc and which are disposed at an equal annular circumferential spacing from one another. The vanes disposed on one side of the disc may be circumferentially aligned with or phase displaced from those disposed on the other side. The impeller also includes side boards 34 which are firmly secured to the opposite sides of the disc. It is to be understood however that the vanes 33 may be disposed on only one side of the disc 31 and the invention is equally applicable to an impeller of semi-open type having no side boards. These are a matter of design, and do not form part of the invention.

Figure 7:
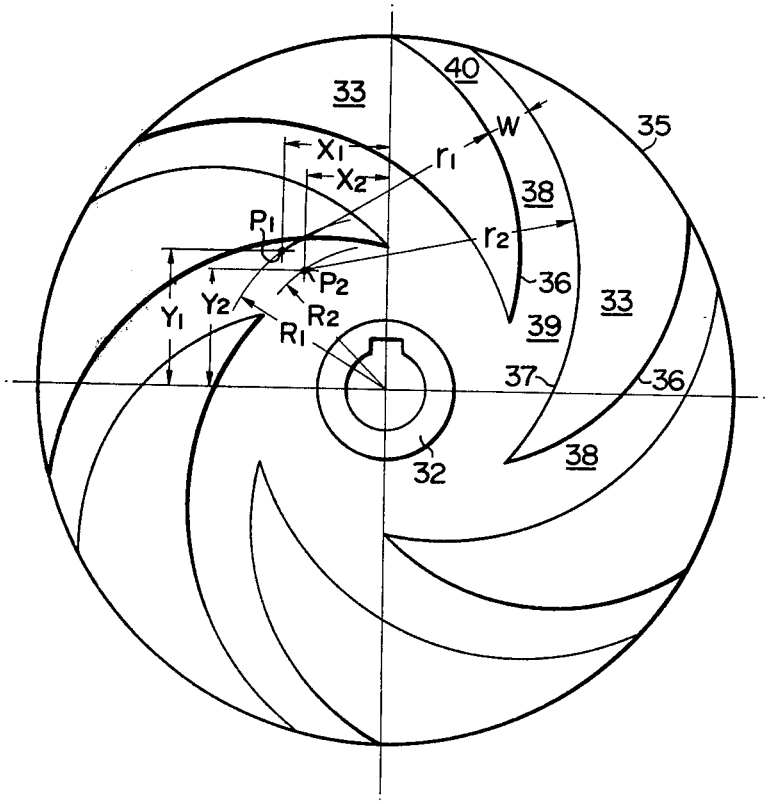
FIG. 7 is a diagrammatic side elevation of the impeller shown in FIG. 6.

Referring to FIG. 7, each vane 33 of the impeller 30 has a circumferential surface 35 which substantially coincides with the outer periphery of the disc 31, and a front surface 36 and a rear surface 37 which are located at an advanced position and at a retarded position, respectively, as viewed in the direction of rotation of the impeller. Part of the rear surface is disposed opposite to but spaced from the boss 32, thus partly surrounding it. Fluid passage 38 is formed between the front surface 36 of each vane 33 and the rear surface 37 of an adjacent vane. The fluid passage 38 extends from a vane inlet 39 located around the boss 32 to a vane outlet 40 located along the outer periphery of the impeller 30. The passage 38 has a width W which gradually decreases from the inlet 39 toward the outlet 40. However, the depth D of the passage 38, that is, the thickness of vane 33 corresponding to the spacing between the disc 31 and side board 34, remains constant. The all or a major part of the front surface 36 of a particular vane and the rear surface 37 of an adjacent vane, which combine together to form a particular passage 38, have different radii of curvature $r_1$, $r_2$ struck from different points $P_1$, $P_2$, which have coordinates $X_1$, $Y_1$ and $X_2$, $Y_2$ as referenced to the orign located at the center of the impeller and which are disposed on circles struck from the origin and having radii $R_1$, $R_2$, respectively. At least the major part of the front and rear surfaces lie along imaginary circles of radii $r_1$ and $r_2$ and as shown in FIG. 7, the boss 32 is positioned completely within all of the imaginary circles along which lie the respective front surfaces 36. Preferred values of these coordinates will be given later, but it is to be noted here that radius of curvature $r_1$ is less than radius of curvature $r_2$ while radius $R_1$ is greater than radius $R_2$. It should be noted, however, that the front surface 36 of a particular vane and the rear surface 37 of an adjacent vane, which combine together to form a particular passage 38, respectively may have at the vicinity of a particular inlet 39 a radius of curvature different from said radii of curvature $r_1$, $r_2$. Side boards 34 are firmly welded to the vanes 33, and are formed with openings 41 which communicate with the inlets 39 of individual passages 38.

The impeller 30 is mounted on the end of a rotary drive shaft 42 which is inserted into a center opening in the disc and boss and is secured thereto by a nut 43. The combination of the impeller and the shaft is assembled into a pump body 44, which includes a pair of inlet paths 45 communicating with the openings 41 and which is provided with a volute casing 47 which defines a gradually enlarging spiral space 46 around the impeller 30. The side boards 34 are formed with annular lips 48 around the openings 41, and rings 49 having a reduced frictional resistance are placed between the lips 48 and the body 44. The volute casing 47 has an inner surface which is U-shaped in longitudinal section, and the spiral space 46 has an opening of a width which is substantially equal to the thickness of the impeller 30 and has a gradually increasing depth. It will be understood that the spiral space 46 leads to a discharge port.

In operation, as the impeller 30 rotates, fluid is admitted into the openings 41 through inlet path 45, and is then forced through the passages 38 into the spiral space 46. The centrifugal force of the vanes 33 imparts kinetic energy to the fluid flow. No substantial vortical flow occurs within the passages 38 from the inlets 39 to the outlets 40 thereof as a result of the gradual decrease in the width combined with the uniform depth of the passages, thus contributing to enhancing the magnitude of the kinetic energy imparted to the flow due to the prevention of fluid vortices from forming along the length of the passages.

Figure 3:
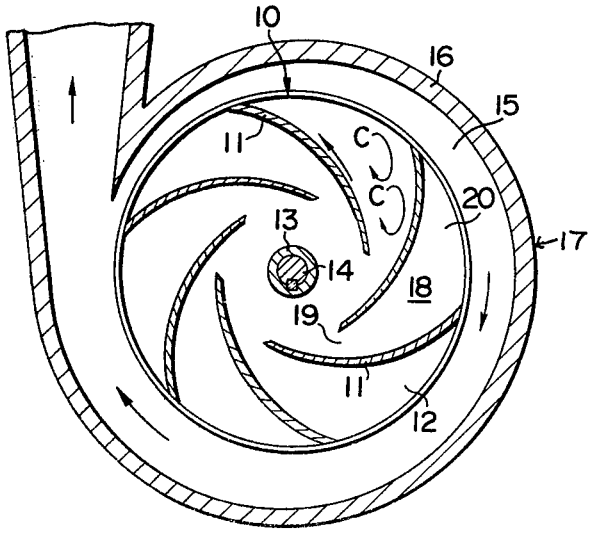
FIG. 3 PRIOR ART
FIG. 3 is an elevational section of a conventional centrifugal pump.
Figure 4:
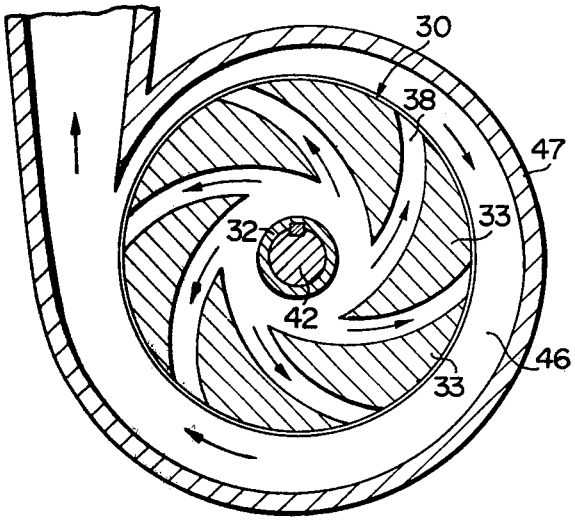
FIG. 4 is an elevational section of the centrifugal pump of the invention.
Figure 5:
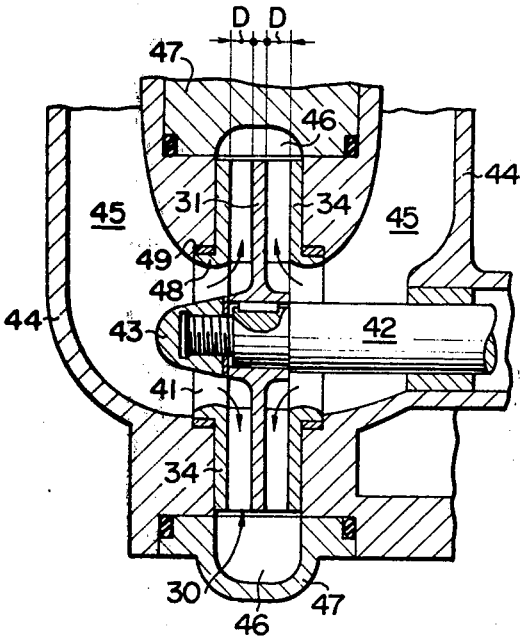
FIG. 5 is a cross section of the pump shown in FIG. 4.
Figure 6:
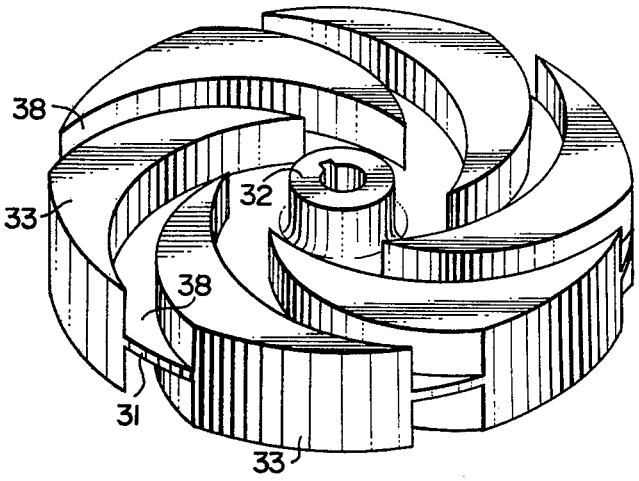
FIG. 6 is a perspective view of the impeller shown in FIGS. 4 and 5.
Figure 8A:
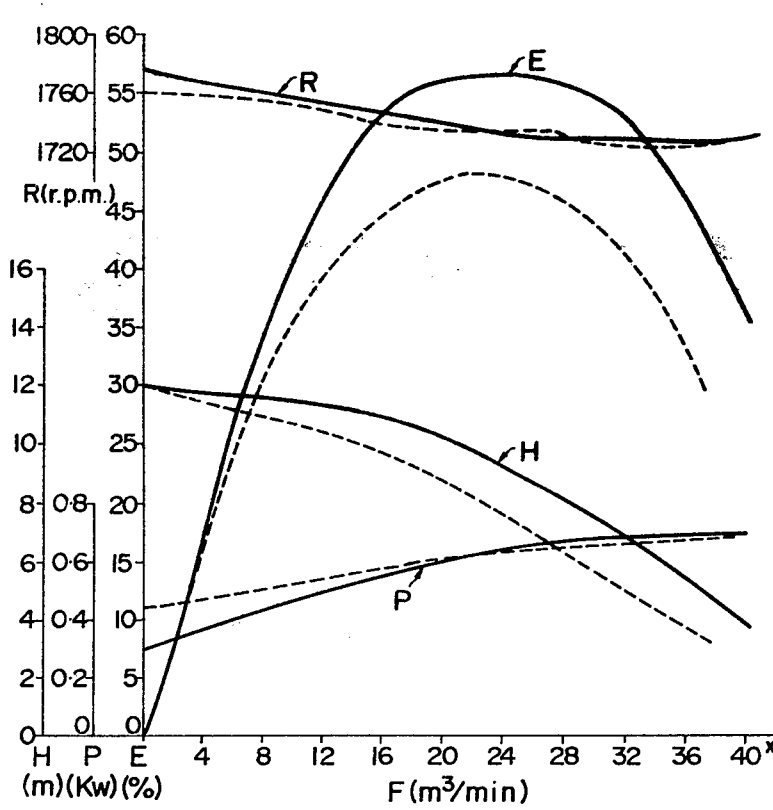
FIGS. 8*a* and 8*b* graphically illustrate the comparative performance of a commercially available standard centrifugal pump and the pump of the invention in which the impeller of the former pump is replaced by the impeller of a corresponding size which is constructed in accordance with the invention.
Figure 8B:
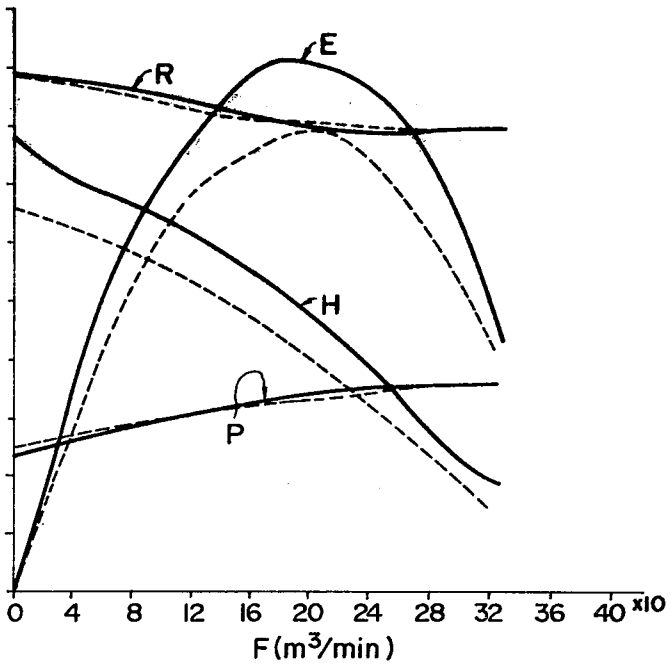

This result has been demonstrated by a comparative performance test using a commercially available standard centrifugal pump of the known type as illustrated in FIG. 3 and the same pump in which the original impeller is replaced by the impeller of the invention, the both pumps being operated under equal operating conditions. The test has been performed generally in conformity to the Japan Industrial Standards (JIS B 8301). Referring to FIG. 8*a* where the efficiency E, shaft power P, total head H and number of revolutions R, all taken on the ordinate, are plotted against the flow rate F shown on the abscissa, the performance of standard pump A is shown in dotted lines while the performance of the corresponding pump A′ modified according to the invention is shown in solid line. The test also covered another standard pump B supplied by a different manufacturer, and the test results are shown in dotted lines in FIG. 8*b* in the same manner as in FIG. 8*a*. The solid line curves in FIG. 8*b* show the performance of a pump B′ which corresponds to the standard pump B, but is modified according to the invention. It will be seen that both the head and the efficiency are significantly improved.

It is to be noted that since the pump of the invention permits the fluid to flow in a given direction while filling the passage 38 and without producing a vortical flow, there can be achieved a complete pressure isolation between the inlet path 45 and the spiral space 46, and the negative pressure in the inlet path 45 reaches 700 to 750 mm Hg.

While the elimination of the vortical flow within the impeller 30 has been demonstrated to produce a significant contribution to the improvement of the performance, it is found that the particular configuration of the volute casing, namely, its inner surface which is U-shaped in longitudinal section, contributes to a further improvement of the performance. While no theoretical explanation can be given, it is believed that since the absence of the vortical flow avoids the need for the pump to provide a commutation effect, the conversion of the kinetic energy into the hydraulic pressures of the fluid is the only function required of the pump, which is optimally accomplished with the described configuration.

In the embodiment shown, the impeller 30 is of dual inlet type and carries six vanes 33 on each side which form six passages 38. While this represents a preferred arrangement, it is to be understood that the invention is not limited thereto. In this respect, it will be understood that the number of vanes 33, the diameter and the thickness of the impeller 30 are a matter of design as recognized in the art. Similarly, the specific size of the fluid passages 38 is to be determined by a design engineer.

However, several specific values of the radii of curvature of the fluid passages 38 will be given below for different values of the depth D of the passages assuming that the diameter of the impeller is constant. As recognized, the diameter of the impeller relates to the discharge head while the depth D relates to the aperture or the discharge flow rate. The values given below are for an impeller of dual inlet type having a diameter of 148 mm and having six vanes on each side. Reference characters used can be understood by reference to FIG. 7. All figures are in millimeters.

| | | | |
|---|---|---|---|
| (1) | D = 2.5 (aperture 32) | | |
| | $P_1 = X_1 . Y_1 = 23 . 26$ | $r_1 = 53$ | $R_1 = 35$ |
| | $P_2 = X_2 . Y_2 = 15.5 . 23$ | $r_2 = 57$ | $R_2 = 30$ |
| (2) | D = 3.5 (aperture 40) | | |
| | $P_1 = X_1 . Y_1 = 23 . 26$ | $r_1 = 53$ | $R_1 = 35$ |
| | $P_2 = X_2 . Y_2 = 18 . 23.5$ | $r_2 = 59$ | $R_2 = 30$ |
| (3) | D = 8 (aperture 50) | | |
| | $P_1 = X_1 . Y_1 = 22 . 28$ | $r_1 = 50$ | $R_1 = 36$ |
| | $P_2 = X_2 . Y_2 = 17 . 24$ | $r_2 = 58$ | $R_2 = 30$ |
| (4) | D = 20 (aperture 100) | | |
| | $P_1 = X_1 . Y_1 = 35 . 20$ | $r_1 = 65$ | $R_1 = 40$ |
| | $P_2 = X_2 . Y_2 = 23 . 19$ | $r_2 = 67.5$ | $R_2 = 30$ |

While the invention has been described in detail with reference to a particular embodiment, it should be understood that it is exemplary only, and not limitative of the invention. Rather, a number of changes and modifications can be made therein as mentioned. Therefore, it is intended that the invention be solely defined by the appended claims.

What is claimed is:

1. An impeller for a centrifugal pump or the like comprising: a main disc having a center opening; an annular boss on at least one side of the disc and surrounding the center opening for attaching the impeller to a rotary shaft inserted into the center opening; and means defining a plurality of circumferentially equi-spaced fluid passages on at least one side of the disc having inlets which open at a circular open region at the disc center for admitting fluid into the passages and outlets which open at the disc periphery for discharging fluid from the passages during rotation of the impeller, said fluid passages having a constant depth and a gradually decreasing width in the direction from their inlet to their outlet and having an arcuate shape and location effective to impart increasing kinetic energy to the fluid during its flow through the passages while effectively preventing formation of fluid vortices throughout the entire length of the passages from the inlets to the outlets, said means defining said plurality of fluid passages comprising a plurality of similarly shaped vanes disposed in equi-spaced apart relation from one another about at least one side of the disc such that each two spaced-apart vanes define therebetween one fluid passage, each vane having a front surface and a rear surface with respect to the direction of rotation of the impeller, the front surface of each vane being spaced from and opposite the rear surface of an adjacent vane to define therebetween one fluid passage, at least the major part of the front and rear surfaces of the vanes lying along imaginary circles of different radii, and the radii of the front surfaces being less than the radii of the rear surfaces, and wherein said boss is positioned substantially completely within all of the imaginary circles along which lie the vane front surfaces.

2. An impeller according to claim 1, wherein the entire length of the front and rear surfaces of the vanes lie along said imaginary circles.

3. A centrifugal pump comprising a drive shaft, an impeller fixedly mounted on the drive shaft, and a body including an inlet path communicating with the impeller and also including a volute casing which defines a spiral space around the impeller, the impeller comprising a main disc having a boss fitted over the shaft and a plurality of vanes disposed at an equal spacing from each other and axially projecting from at least one side of the disc, each vane having a front and a rear surface, part of the rear surface being opposite to and spaced from the boss in surrounding relationship therewith, a fluid passage being formed between the front surface of each vane and the remainder of the rear surface of its adjacent vane and extending from a region around the boss to the outer periphery of the disc, each vane having a constant axial thickness, the major part of the front surface of each vane and the rear surface of the adjacent vane which together form a passage therebetween being segments of circles struck from different points on the disc and of different radii so that the passage formed therebetween has a constant depth and a width which gradually decreases from said region toward the outer periphery of the disc, the front surface of each vane having a radius of curvature which is less than that of the rear surface of the adjacent vane with which it forms the passage and which is struck from a point further spaced from the axis of the impeller than a point from which the radius of curvature of the rear surface of said adjacent vane is struck, said boss being positioned substantially completely within all of the circles along which lie the respective vane front surfaces.

4. A centrifugal pump according to claim 3 in which the volute casing has an inner surface which is U-shaped in longitudinal section and the spiral space includes an opening of a width which is substantially equal to the thickness of the impeller.

5. A centrifugal pump according to claim 3 in which the impeller has another plurality of vanes located on the other side of the disc which are disposed symmetrically with the first mentioned vanes.

6. A centrifugal pump according to claim 3 in which the impeller includes a side board which is rigidly secured to the side of the vanes, the side board having an opening which provides a fluid communication between the inlet path and the fluid passages.

7. A centrifugal pump according to claim 3 in which said boss is positioned entirely within all of the circles along which lie the respective vane front surfaces.

* * * * *